United States Patent [19]

Marks et al.

[11] Patent Number: 4,557,123

[45] Date of Patent: Dec. 10, 1985

[54] SLIDE ACTION KEY SHEILD

[76] Inventors: Arthur D. Marks, 505 Cherry St., Oxford, N.C. 27565; Ronald L. Schultz, 1937 Buena Vista Dr., Terre Haute, Ind. 47802

[21] Appl. No.: 571,346

[22] Filed: Jan. 16, 1984

[51] Int. Cl.[4] ..... E05B 19/00

[52] U.S. Cl. ..... 70/395; 70/456 R

[58] Field of Search ..... 70/395, 397, 398, 456 R

[56] References Cited

U.S. PATENT DOCUMENTS

| | | | |
|---|---|---|---|
| 14,958 | 5/1856 | Hendrickson | 70/398 |
| 104,823 | 6/1870 | Brady | 70/397 |
| 468,807 | 2/1892 | Kintner | 70/397 |
| 1,924,134 | 8/1933 | Segal | 70/456 R |
| 1,934,889 | 11/1933 | Segal | 70/456 R |
| 1,974,547 | 9/1934 | Slade | 70/456 R |
| 2,180,717 | 11/1939 | Nelson | 70/456 R |
| 2,270,621 | 1/1942 | Brugnoni | 70/456 R |
| 2,509,318 | 5/1950 | Segui, Jr. | 70/456 R |
| 3,613,414 | 10/1971 | Ostrager | 70/456 R |

FOREIGN PATENT DOCUMENTS

| | | | |
|---|---|---|---|
| 279109 | 9/1914 | Fed. Rep. of Germany | 70/395 |
| 21186 | of 1911 | United Kingdom | 70/391 |

OTHER PUBLICATIONS

Spring Loaded Key Shield Manufactured by the Folger Adam Company of Joliet, Illinois.

*Primary Examiner*—Robert L. Wolfe

*Attorney, Agent, or Firm*—Jeffry H. Nelson; Thomas J. Byrnes; Vito J. DiPietro

[57] ABSTRACT

A slide action key shield to hide and protect a key's tumbler cuts and then, on demand, retract to fully expose the tumbler cuts when opening a lock is disclosed. A double capped pin is fixed through the key near the midpoint along the key's length such that each capped end protrudes through a respective longitudinal face slot on the shield to allow the shield to movably cover one half of the shaft of the key or the other. The shield resembles a longitudinally extended sheath open at both ends which conforms to the shape of the key. One end of the shield is flat so that the shield may be easily pushed back by the lock face while the other end is rounded and given side openings to fully retract over the key head without any sharp edges protruding. If the key head is held by a key ring, the retracted shield will be returned by the force of gravity to cover the tumbler cuts when the key is left to hang after use.

8 Claims, 4 Drawing Figures

SLIDE ACTION KEY SHEILD

BACKGROUND OF THE INVENTION

1. Field of the Invention

The present invention relates to the art of key cases and particularly to those key cases used in prisons for security purposes which cover only a portion of the key.

In prisons, it is important that a prisoner not be allowed to see the tumbler cuts on cell keys. If the tumbler cuts are exposed, the prisoner may try to duplicate the key or tamper with the cell lock. A key case which shields the tumbler cuts can, therefore, make an important contribution to overall prison security.

Nonetheless, a tumbler cut key shield must also be convenient and workable for the prison guard. It should easily retract to expose the tumbler cuts when the lock must be used but then automatically return to re-cover the tumbler cuts when the key is no longer needed. The key shield should be of sturdy construction with a minimum of parts to withstand the rough prison environment and yet be inexpensive. Also the key shield should not interfere with the free interchangeability of prison keys between key rings nor should it block out any serial numbers that are stamped on the key.

2. Description of the Prior Art

Key cases of various types have long been known. The inventors are aware, for instance, of several patents in which a key is held inside a case by a button pin. In each of these patents, the case is at least large enough to cover the entire key and, in some instances, it can completely cover several keys. The neck of the button pin is channeled into a longitudinal slot in the case which allows the key to be exposed and retracted by pushing the button portion of the pin back and forth within the longitudinal slot. U.S. Pat. Nos. 1,924,134 (H.R. Segal), 1,934,889 (H.R. Segal), 1,974,547 (A.R. Slade), 2,180,717 (E.C. Nelson), 2,270,621 (R. C. Brugnoni) and 2,509,318 (A. Segui, Jr.) disclose such key cases. These key cases have the drawback of being bulky in comparison to the size of the key. Unlike the present invention, the key and key case cannot be conveniently placed on or interchanged between key rings. Using such key cases, a prison guard would not be able to carry the usual 30 or more keys on a key ring attached to his belt. These key cases are also more difficult to operate than the present invention. One must push on the button pin to expose the key and then remember to pull back on the button to retract the key. Using the present invention, one can expose the key tumbler cuts merely by pushing the key against the lock opening, and the shield falls back to re-cover the tumbler cuts after use merely by letting the key hang from a key ring. The present invention achieves an economy of space and simplicity of use unknown in the slotted key case prior art.

A spring loaded key shield manufactured by the Folger Adam Company of Joliet, Illinois has recently been used in prisons to hide the tumbler cuts of keys. The Folger Adam shield covers only the tumbler cut half of the key and is anchored by a pin placed through the key at a point near the center of the key's faces. The Folger Adam shield swings laterally away from the key when the key is in use and then the spring snaps it back when the key is pulled away from the lock. Serious maintenance difficulties have been created by the use of a spring on the Folger Adam shield. The springs will often bend, rust or break. Sometimes the anchoring pin must be drilled out to replace a broken spring. The Folger Adam shield has also been awkward to use because the spring pressure causes the shield to press against the lock and interfere with turning the key to unlock the door.

The present invention is a simpler, less expensive device which eliminates the difficulties associated with spring loading. The only moving part of the present invention is the shield itself. There is very little that can go wrong with the present invention regardless of the treatment it receives. The shield on the present invention also moves straight back so as not to interfere with the key turning operation. The present invention overcomes the disadvantages of the prior art to create a durable, inexpensive and practical key shield.

SUMMARY OF THE INVENTION

It is an object of the present invention to provide a convenient and workable key shield which retracts from the key tumbler cuts as the key is inserted into a lock but then falls back to re-cover the tumbler cuts when the key is hung from a key ring.

It is further object of the present invention to provide an inexpensive, durable key shield for individual keys with a minimum of moving parts such that the shielded keys can easily be kept on and interchanged between key rings.

Broadly, the key shield of this invention resembles a longitudinally extended sheath which is open at both ends. In cross section, the shield may be either rectangular, oval, or any other shape which conforms to the cross-section of the key. At least one face of the shield has a longitudinal slot. The shield is attached to the key by a pin which is fixed to the key near the key's midpoint and which extends through the slot on the shield. The shield rides on the pin to either cover or expose the tumbler cuts. One end of the shield is flat so that the shield may be easily pushed back by the lock face while the other end is rounded to prevent injury and inconvenience when the shield is retracted.

These and additional objects, features and advantages of the present invention will become apparent to those skilled in the art from the following detailed description and the attached drawings on which, by way of example, only the preferred embodiments of this invention are illustrated.

DESCRIPTION OF THE PREFERRED EMBODIMENTS

Figure 1:
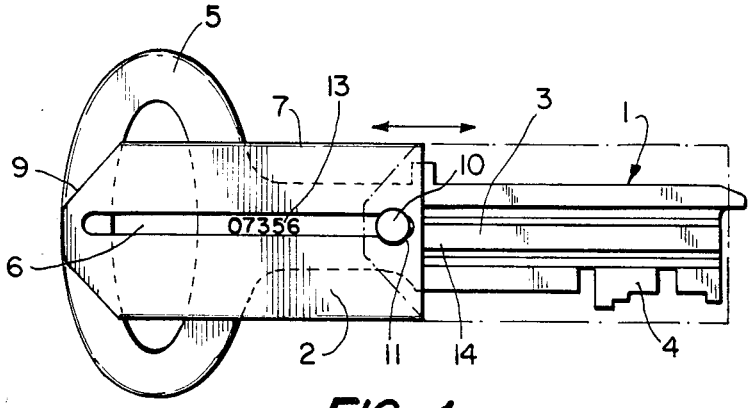
FIG. 1 shows a slide action key shield fitted onto a key and retracted over the key head to expose the key's tumbler cuts.
Figure 2:
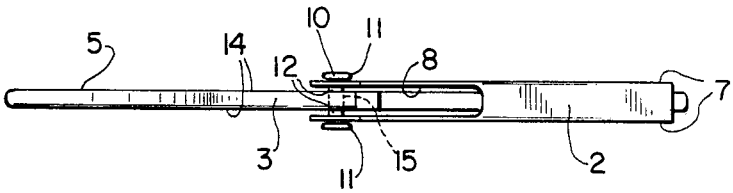
FIG. 2 is a top view of the slide action key shield assembly shown in FIG. 1 but where the shield has been moved to fully cover the key's tumbler cuts.
Figure 3:
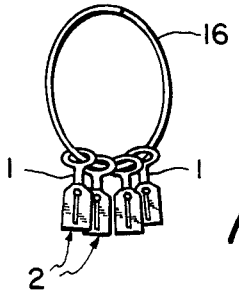
FIG. 3 illustrates that numerous keys equipped with slide action key shields can be conveniently carried on a key ring.

As shown in the FIGS. 1 and 2, the shield 2 is generally formed in the shape of a hollow box when covering a flat prison key 1. Where the key is not flat, the shield can of course assume other shapes approximating the shape of the key. The shield is preferably constructed from a durable material such as metal or a hard plastic. The length of the shield is such that it is slightly greater than half the length of the key 1. The width and thickness of the shield 2 conform closely to the width and thickness of the shaft 3 and tumbler cuts 4 of the key allowing free movement of the shield along the length of the key but avoiding unnecessary bulkiness.

A longitudinal slot 6 is formed along the center line of each of the shield's two face plates 7. These slots should extend nearly the length of the sheld to allow the shield to movably cover the tumbler cuts 4 and alternatively to retract clear of the tumbler cuts and over the key's head 5. The width of the slot should be such that it exceeds the diameter of the pin neck 12 by enough to allow free movement of the shield and yet is less than the diameter of the pin cap 11 to prevent the shield from being lifted over the pin 10. It should be noted that the longitudinal slots can permit any serial numbers 13, which are stamped onto a face of the key, to remain visible despite the presence of the sheld.

Side openings 8 are formed on the sides of the shield to allow the shield to retract over the key head 5. These side openings 8 should be large enough to allow the shield to be retracted for the entire length of the longitudinal slot 6.

The end of the shield 2 may also be rounded 9 or otherwise shaped to eliminate any protrusions or sharp corners when the shield is fully retracted over the key head.

A double capped pin 10 is fixed through the key near the mid-point of the key width and length so that it protrudes from both key faces 14 equally. The double capped pin 10 is preferably formed by screwing a capped screw into a hollow capped pin. Other variations include a capped pin with a Truarc clip, a capped pin with a lock washer and two threaded capped pins. The pin 10 should be located in conjunction with the slot 6 to allow free movement of the shield over the shaft 3 of the key such that the shield 2 can fully cover the tumbler cuts when closed and then easily retract to pull well away from the tumbler cuts when the key is in use.

The slide action key shield can easily be assembled by drilling a hole 15 through the key where the pin 10 will be inserted. The slotted shield 2 is then placed over the key with the double capped pin 10 then being assembled through the longitudinal slots 6 and pin hole 15. The capped pin 10 should fit snugly in the hole so that for all practical purposes it is immovable.

The slide action key shield 2 will automatically retract to expose the tumbler cuts 4 when the key is pressed against the key hole of a lock. If the key head 5 is held by a key ring 16, the retracted shield will be returned by the force of gravity to cover and protect the tumbler cuts when the key is left to hang after use.

Figure 4:
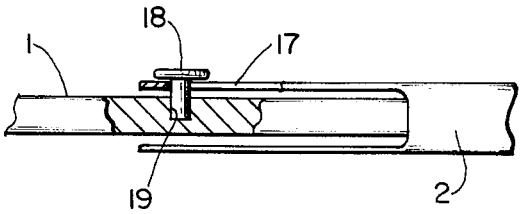
FIG. 4 depicts another embodiment of the invention where a single capped pin protrudes from only one side of the key and through a single longitudinal shield slot.

Another embodiment illustrating the principles of this invention is shown in FIG. 4. In this embodiment there is only one longitudinal slot 17 on the key shield. A single capped pin 18 protrudes through this slot and may be secured to the key by a shallow hole 19 extending through only part of the key.

Although the present invention has been described with respect to specific details of certain embodiments, it is not intended that such details be limitations upon the scope of the invention except insofar as set forth in the following claims.

We claim:

1. A slide action key shield attached to a key comprising;

a. a pin protruding from said key near the midpoint along said key's length, b. a slidable shield means covering a part of said key, said shield means being movable by the force of gravity to cover said key part, and c. a longitudinal slot on said slidable shield means into which said pin is inserted.

2. A slide action key shield attached to a key as set forth in claim 1 wherein:

a. said slidable shield means fully covers the tumbler cuts of said key.

3. A slide action key shield attached to a key as set forth in claim 1 wherein:

a. said pin is a capped pin with said capped portion outside of and being wider than said longitudinal slot.

4. A slide action key shield attached to a key as set forth in claim 1 further comprising:

d. side openings on said shield means to permit said shield means to retract over the key head, and e. a contouring of that portion of said shield means closest to said key head to eliminate any sharp edges.

5. A slide action key shield attached to a key comprising:

a. a pin inserted through said key near the midpoint along said key's length and protruding from two surfaces of said key, b. a slidable shield means fully covering a part of the shaft of said key, said shield means being movable by the force of gravity to cover said part of said key shaft, and c. two longitudinal slots on said slidable sheld means such that each opposite end of said pin is inserted through one of said slots.

6. A slide action key shield attached to a key as set forth in claim 5 wherein:

a. said slidable shield means fully covers the tumbler cuts of said key.

7. A slide action key shield attached to a key as set forth in claim 5 wherein:

a. said pin is capped at both ends with said capped portions outside of and being wider than said longitudinal slot.

8. A slide action key shield attached to a key as set forth in claim 5 further comprising:

d. side openings on said shield means to permit said shield to retract over the key head, and e. a contouring of that portion of said shield means closest to said key head to eliminate any sharp edges.

* * * * *